US005119892A

United States Patent [19]

Clegg et al.

[11] Patent Number: 5,119,892

[45] Date of Patent: Jun. 9, 1992

[54] NOTARY DRILL BITS

[75] Inventors: John M. Clegg, Bristol; Malcolm R. Taylor, Gloucester; Leslie R. Hawke, Stroud, all of England

[73] Assignee: Reed Tool Company Limited, Stonehouse, England

[21] Appl. No.: 616,635

[22] Filed: Nov. 21, 1990

[30] Foreign Application Priority Data

Nov. 25, 1989 [GB] United Kingdom ..... 8926688

[51] Int. Cl.[5] ..... E21B 10/46

[52] U.S. Cl. ..... 175/431; 175/408; 175/425

[58] Field of Search ..... 175/399, 400, 398, 329, 175/343, 374, 376, 410, 408; 76/108.2, 108.4

[56] References Cited

U.S. PATENT DOCUMENTS

| | | | |
|---|---|---|---|
| 1,587,266 | 6/1926 | Zublin | 175/397 |
| 2,074,951 | 3/1937 | Zublin . | |
| 2,931,630 | 4/1960 | Grady | 175/392 |
| 3,120,285 | 2/1964 | Rowley et al. | 175/408 |
| 3,215,215 | 11/1965 | Kellner | 175/330 |
| 3,455,402 | 7/1969 | Tiraspolsky | 175/327 |
| 3,851,719 | 12/1974 | Thompson et al. | 175/406 |
| 3,908,771 | 9/1975 | Garrett | 175/393 |
| 3,923,109 | 12/1975 | Williams | 175/340 |
| 4,220,213 | 9/1980 | Hamilton | 175/45 |
| 4,463,220 | 7/1984 | Gonzalez | 175/343 |
| 4,635,738 | 1/1987 | Schillinger et al. | 175/398 |
| 4,982,802 | 1/1991 | Warren et al. | 175/57 |
| 5,010,789 | 4/1991 | Brett et al. | 76/108.2 |

FOREIGN PATENT DOCUMENTS

| | | |
|---|---|---|
| 0165687 | 12/1985 | European Pat. Off. . |
| 0384734 | 8/1990 | European Pat. Off. . |
| 8002858 | 12/1980 | PCT Int'l Appl. . |
| 8902023 | 3/1989 | PCT Int'l Appl. . |
| 2167107 | 5/1986 | United Kingdom . |

OTHER PUBLICATIONS

"Bit Whirl-A New Theory of PDC Bit Failure", paper No. SPE 15971, by J. F. Brett, T. M. Warren and S. M. Behr, Society of Petroleum Engineers, 64th Annual Technical Conference, San Antonio, TX. Oct. 8-11, 1989.

"Development of a Whirl Resistant Bit", paper No. 19572, by T. M. Warren, Society of Petroleum Engineers, 64th Annual Technical Conference, San Antonio, TX, Oct. 8-11, 1989.

*Primary Examiner*—Stephen J. Novosad

*Attorney, Agent, or Firm*—Browning, Bushman, Anderson & Brookhart

[57] ABSTRACT

A rotary drill bit comprises a bit body having a shank for connection to a drill string and a passage for supplying drilling fluid to the face of the bit, which carries a plurality of polycrystalline diamond preform cutting elements. The cutting elements on one side of a diameter of the bit have positive side rake and the cutting elements on the other side of the diameter have negative side rake so that the vectorial sum of the reaction forces between the formation being drilled and the cutting elements provides a resultant lateral imbalance force acting on the bit body as it rotates in use. The gauge of the bit body includes low friction bearing pads so located as to transmit the resultant lateral force to the sides of the borehole. Since the bearing pads are of low friction, they slide around the surface of the formation and any tendency for bit whirl to be initiated is reduced. The lateral imbalance force may also be provided by varying the back rake of the cutting elements on different parts of the bit, or by including an asymmetrical mass of material in the bit body.

4 Claims, 4 Drawing Sheets

NOTARY DRILL BITS

BACKGROUND OF THE INVENTION

The invention relates to rotary drill bits for use in drilling or coring holes in subsurface formations, and particularly to polycrystalline diamond compact (PDC) drag bits.

A rotary drill bit of the kind to which the present invention relates comprises a bit body having a shank for connection to a drill string and a passsage for supplying drilling fluid to the face of the bit, which carries a plurality of preform cutting elements each formed, at least in part, from polycrystalline diamond. One common form of cutting element comprises a tablet, usually circular or part-circular, made up of a superhard table of polycrystalline diamond, providing the front cutting face of the element, bonded to a substrate which is usually of cemented tungsten carbide.

The bit body may be machined from solid metal, usually steel, or may be moulded using a powder metallurgy process in which tungsten carbide powder is infiltrated with metal alloy binder in a furnace so as to form a hard matrix.

While such PDC bits have been very successful in drilling relatively soft formations, they have been less successful in drilling harder formations and soft formations which include harder occlusions or stringers. Although good rates of penetration are possible in harder formations, the PDC cutters suffer accelerated wear and bit life can be too short to be commercially acceptable.

Recent studies have suggested that the rapid wear of PDC bits in harder formations is due to chipping of the cutters as a result of impact loads caused by vibration, and that the most harmful vibrations can be attributed to a phenomenon called "bit whirl". ("Bit Whirl—A New Theory of PDC Bit Failure"—paper No. SPE 15971 by J. F. Brett, T. M. Warren and S. M. Behr, Society of Petroleum Engineers, 64th Annual Technical Conference, San Antonio, Oct. 8-11, 1989). Bit whirl arises when the instantaneous axis of rotation of the bit precesses around the central axis of the hole when the diameter of the hole becomes slightly larger than the diameter of the bit. When a bit begins to whirl some cutters can be moving sideways or backwards relatively to the formation and may be moving at much greater velocity than if the bit were rotating truly. Once bit whirl has been initiated, it is difficult to stop since the forces resulting from the bit whirl, such as centrifugal forces, tend to reinforce the effect.

Attempts to inhibit the initiation of bit whirl by constraining the bit to rotate truly, i.e., with the axis of rotation of the bit coincident with the central axis of the hole, have not been particularly successful.

Although it is normally considered desirable for PDC drill bits to be rotationally balanced, in practice some imbalance is tolerated. Accordingly it is fairly common for PDC drill bits to be inherently imbalanced, i.e. when the bit is being run there is, due to the cutting, hydraulic and centrifugal forces acting on the bit, a resultant force acting on the bit, the lateral component of which force, during drilling, is balanced by an equal and opposite reaction from the sides of the borehole.

This resultant lateral force is commonly referred to as the bit imbalance force and is usually represented as a percentage of the weight-on-bit since it is almost directly proportional to weight-on-bit. It has been found that certain imbalanced bits are less susceptible to bit whirl than other, more balanced bits. ("Development of a Whirl Resistant Bit"—paper No. SPE 19572 by T. M. Warren, Society of Petroleum Engineers, 64th Annual Technical Conference, San Antonio, Oct. 8-1989). Investigation of this phenomenon has suggested that in such less susceptible bits the resultant lateral imbalance force is directed towards a portion of the bit gauge which happens to be free of cutters and which is therefore making lower "frictional" contact with the formation than other parts of the gauge of the bit on which face gauge cutters are mounted. It is believed that, since a comparatively low friction part of the bit is being urged against the formation by the imbalance force, slipping occurs between this part of the bit and the formation and the rotating bit therefore has less tendency to precess, or "walk", around the hole, thus initiating bit whirl.

(Although, for convenience, reference is made herein to "frictional" contact between the bit gauge and formation, this expression is not intended to be limited only to rubbing contact, but should be understood to include any form of engagement between the bit gauge and formation which applies a restraining force to rotation of the bit. Thus, it is intended to include, for example, engagement of the formation by any cutters or abrasion elements which may be mounted on the part of the gauge being referred to.)

This has led to the suggestion, in the above-mentioned paper by Warren, that bit whirl might be reduced by omitting cutters from one sector of the bit face, so as deliberately to imbalance the bit, and providing a low friction pad on the bit body for engaging the surface of the formation in the region towards which the resultant lateral force due to the imbalance is directed.

Experimental results have indicated that this approach may be advantageous in reducing or eliminating bit whirl. However, the omission of cutters from one sector of a PDC bit can have disadvantages. Not only does it reduce the maximum number of cutters which can be mounted on the bit but it also imposes serious limitations on the disposition of cutters and on bit design in general. In other words, other desirable characteristics of the PDC bit may have to be sacrificed in order to permit the omission of cutters from one sector of the bit face.

The present invention therefore sets out to provide various mehtods whereby the desirable imbalance of a PDC bit may be achieved while still allowing substantial freedom in the disposition of cutters on the face of the bit and, in some cases, no reduction in the maximum number of cutters which may be employed on the bit. cl

SUMMARY OF THE INVENTION

According to one aspect of the invention there is provided a rotary drill bit comprising a bit body having a shank for connection to a drill string and a passage for supplying drilling fluid to the face of the bit, which carries a plurality of preform cutting elements each formed, at least in part, from polycrystalline diamond, some cutting elements on the bit body having their cutting faces at a different angular orientation from the cutting faces of other cutting elements on the bit body, with respect to the axis of rotation of the bit, the different angular orientations of the cutting faces of the respective cutting elements being so selected that the vectorial sum of the reaction forces between the formation being drilled and the cutting elements provides a resultant lateral imbalance force acting on the bit body as it rotates in use, the gauge of the bit body including at least one low friction bearing pad so located as to transmit said resultant lateral force to the part of the formation with which the bearing pad is for the time being engaged.

The front cutting face of a PDC cutting element is disposed at an angle to the surface of the formation being cut, as viewed in a plane normal to the formation and extending in the direction of movement of the cutter relative to the formation. In the case where the cutting face leans forwardly in the direction of movement with respect to the formation, the angle which the cutting face makes to the normal is referred to as a negative back rake angle. Different back rake angles produce different forces acting on the bit as a result of the interaction between the cutter and the formation.

Accordingly, in one embodiment of the invention some cutting elements have their cutting faces orientated at a different back rake angle from the back rake angle of other cutting elements on the bit body, the different back rake angles of the respective cutting elements being so selected as to provide said resultant lateral imbalance force.

It is also well known to provide PDC cutting elements with side rake. If the cutting element is orientated so as to tend to urge cuttings outwardly towards the periphery of the drill bit, this may be referred to as positive side rake, whereas if the cutting element is orientated to tend to urge cuttings inwardly towards the axis of the drill bit this may be referred to as negative side rake. Both negative and positive side rake tend to apply a lateral force to the bit body in use, and PDC bits are normally designed so that the forces due to side rake cancel out so that there is no resultant lateral force acting on the bit.

According to an embodiment of the present invention some cutting elements may have their cutting faces orientated at a different side rake angle from the side rake angle of other cutting elements on the bit body, the different side rake angles of the respective cutting elements being so selected as to provide said resultant lateral imbalance force.

For example, cutting elements on one side of a diameter of the bit may have a different side rake angle from cutting elements on the other side of the diameter. In this case, cutting elements on said one side of the diameter may have positive side rake and cutting elements on the other side of the diameter may have negative side rake, said low friction bearing pad being located on the same side of the diameter as those cutting elements having negative side rake.

According to another aspect of the invention there is provided a rotary drill bit comprising a bit body having a shank for connection to a drill string and a passage for supplying drilling fluid to the face of the bit, which carries a plurality of preform cutting elements each formed, at least in part, from polycrystalline diamond, the centre of gravity of the bit body being offset offset from the central axis of rotation of the bit body so as to apply a resultant lateral imbalance force to the bit body as it rotates in use, the gauge of the bit body including at least one low friction beaing pad so located as to transmit said resultant lateral force to the part of the formation which the bearing pad is for the time being engaging.

The centre of gravity of the bit body may be offset from the central axis of rotation by the inclusion in the bit body of a mass of material which is asymmetrically disposed with respect to the central axis of the bit.

For example, the bit body may comprise a solid infiltrated matrix moulded around a steel blank, the steel blank including a cavity asymmetrically disposed with respect to the axis of rotation of the bit, the cavity being filled with denser material, for example matrix material, which thereby constitutes the aforesaid mass of material.

Alternatively, the bit body may comprise a solid infiltrated matrix moulded around a steel blank, a portion of the matrix asymmetrically offset from the axis of the bit being of different density from the rest of the matrix.

In another embodiment the bit body is machined from steel and is formed with a cavity which is asymmetrically offset from the axis of the bit, said cavity being filled with a body of a material of different density from the steel from which the rest of the bit body is formed.

It will be appreciated that certain of the different aspects of the present invention referred to above may be combined to produce the required effect.

DETAILED DESCRIPTION OF THE PREFERRED EMBODIMENTS

Figure 1:
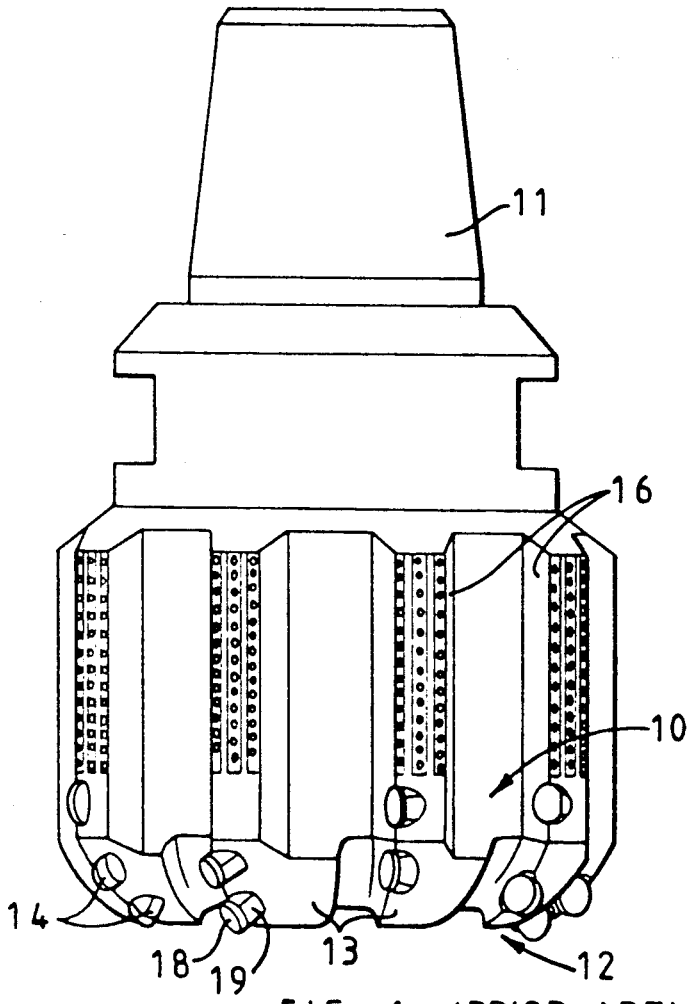
FIG 1 (PRIOR ART)
FIG. 1 is a side elevation of a typical prior art PDC drill bit.
Figure 2:
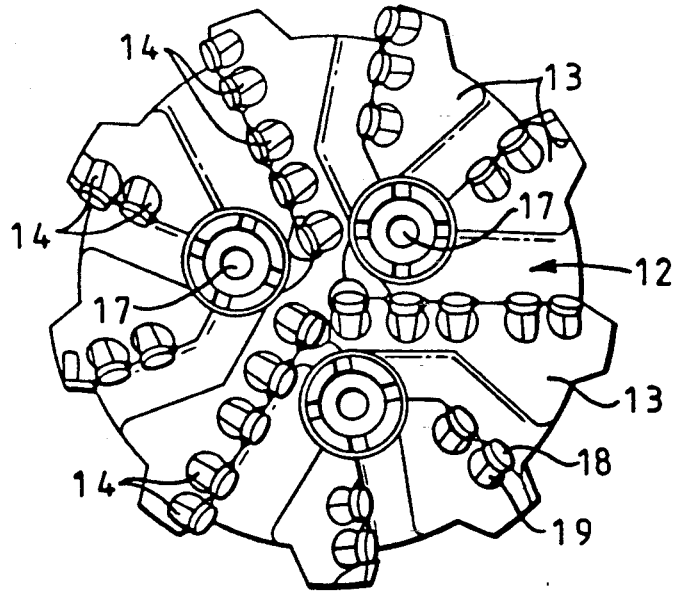
FIG 2 (PRIOR ART)
FIG. 2 is an end elevation of the drill bit shown in FIG. 1.

Referring to FIGS. 1 and 2, these show a prior art full bore PDC drill bit.

The bit body 10 typically moulded from tungsten carbide matrix infiltrated with a binder alloy, and has a steel shank having at one end a threaded pin 11 for connection to the drill string. The operative end face 12 of the bit body is formed with a number of blades 13 radiating from the central area of the bit, the blades carrying cutting structures 14 spaced apart along the length thereof.

The bit gauge section 15 includes kickers 16 which contact the walls of the borehole to stabilise the bit in the borehole. A central passage (not shown) in the bit body and the shank delivers drilling fluid through nozzles 17 to the end face 12 in known manner.

It will be appreciated that this is only one example of many possible variations of type of PDC bit, including bits where the body is machined from steel.

In many such drill bits and in the bit shown in FIGS. 1 and 2, each cutting structure 14 comprises a circular preform cutting element mounted on a carrier in the form of a stud which is secured, for example by brazing or shrink fitting, in a socket in the bit body. Each cutting element typically comprises a thin table of polycrystalline diamond bonded to a less hard substrate, usually tungsten carbide, the substrate in turn being bonded to the carrier.

A drill bit of the kind shown in FIGS. 1 and 2 is normally designed so as to be substantially balanced, that is to say so that the lateral components of the forces acting on the bit during drilling operations substantially cancel out so as to leave no net lateral force acting on the bit. In practice, however, due to manufacturing tolerances and the unpredictability of certain of the forces acting on the bit, complete balance is difficult to achieve and most bits are imbalanced to a certain extent. According to the above-mentioned paper by Warren, 10% imbalance is typical, and values greater than 15% are not unusual. As a result, one part of the gauge section of the bit, in the direction of the imbalance force, tends to be urged towards the formation. Since kickers 16 carrying abrasion elements are disposed equally around the whole periphery of the bit, the portion of the gauge urged against the formation by the imbalance force engages the formation with high frictional contact and, as previously explained, this may result in the bit beginning to precess or "walk" around the hole in the opposite direction to the direction of rotation of the bit, and this action initiates bit whirl.

There will now be described various arrangements in accordance with the invention for deliberately imparting a lateral imbalance force to the bit and disposing a low friction bearing pad at the gauge in the direction of the imbalance force so that this gauge portion tends to slip on the surface of the gauge portion, thus preventing precession from occurring. Preferably the deliberate imbalance is greater than that typically found, due to manufacturing tolerances etc., in conventional PDC drill bits, i.e. is greater than 10%, and is more preferably greater than 15%.

Since, in accordance with the invention, the imbalance of the bit is deliberately effected by the design of the bit, the direction of the imbalance force is controlled and predetermined, enabling a low friction bearing pad to be positioned on the gauge in the appropriate location to react the imbalance force.

Figure 3:
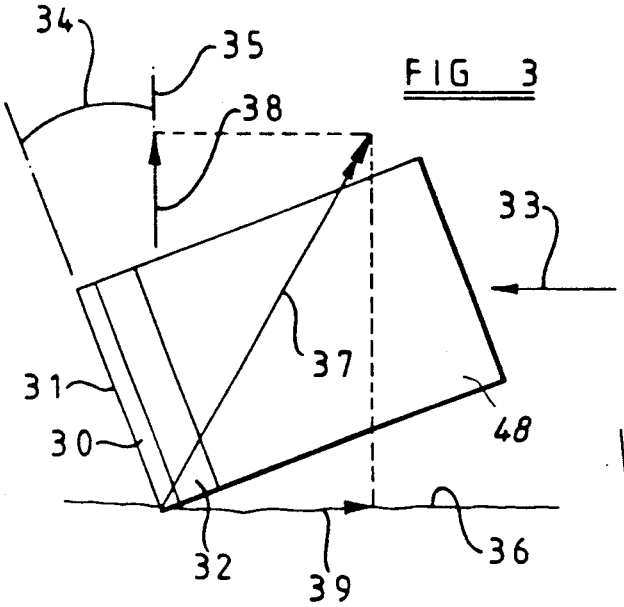
FIG. 3 is a diagrammatic side elevation of PDC cutting element showing its back rake.
Figure 4:
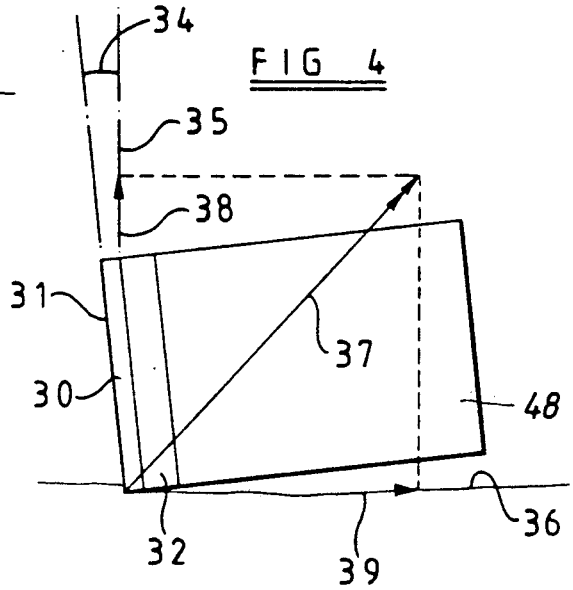
FIG. 4 is a similar view of a further cutting element showing a different back rake.

FIGS. 3 and 4 illustrate diagrammatically cutting elements orientated with different back rake angles. In each case the cutting element is in the form of a circular tablet comprising a front superhard cutting table 30 of polycrystalline diamond, providing a front cutting face 31, bonded to a substrate 32 of cemented tungsten carbide. The cutting element is normally mounted on a carrier 48 received in a socket in the bit body or may, in some cases, be directly mounted on the bit body.

It will be seen that the front cutting face 31 of the cutting element leans forwardly in the direction of movement of the cutting element during drilling as indicated by the arrow 33. The angle 34 which the front cutting face 31 makes to the normal 35 is referred to as a negative back rake angle.

The reaction force acting on the bit as a result of cutting engagement of the cutting element with the formation 36 is indicated at 37 and this may be resolved into a vertical component 38 in a direction parallel to the axis of rotation of the bit, and a horizontal component 39. FIG. 3 shows a cutting element having a 20° negative back rake angle whereas FIG. 4 shows a similar cutting element having a 5° negative back rake angle. It will be seen that the horizontal component 39 of the reaction force is greater in the case of the smaller negative back rake angle. Accordingly, the back rake angles or cutters distributed over the face of the bit may be varied so that the vectorial sum of the horizontal components of the reaction forces results in a net force acting on the bit body. The lateral component of this resultant force then provides the lateral imbalance force required by the invention and the bit body is provided with one or more low friction bearing pads on the region of the gauge portion through which the resultant lateral force passes.

The low friction bearing pad may take any suitable form. For example, it may comprise a portion of the gauge which is free, or substantially free, of abrasion elements or cutting elements and also preferably free of junk slots since the edges of such junk slots increase the resistance to slipping of the gauge portion. The simplest form of low friction bearing pad is simply a smooth surface area of bit body material, but other more elaborate means of providing the low friction characteristic may be provided, as described in our co-pending British Application No. 8926689-4.

Instead of a single bearing pad there may be provided two or more spaced low friction bearing pads around the appropriate portion of the gauge. The bearing pad or pads are preferably of sufficient circumferential extent to accommodate reasonable variations in the direction of the imbalance force, which may arise due to manufacturing tolerances or to variations in the operating conditions of the bit.

A low friction bearing pad or pads will also be present in the further arrangements according to the invention to be described below, and these may also be as just described and will not be described in further detail in each particular embodiment.

Figure 5:
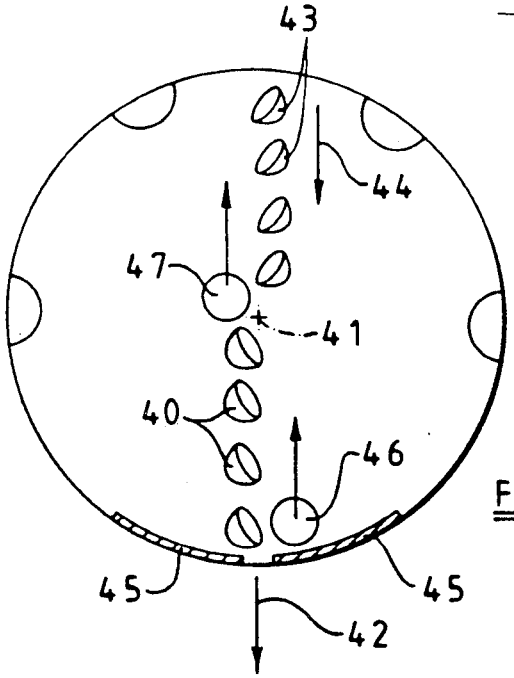
FIG. 5 is a diagrammatic end elevation of a PDC drill bit according to the invention.

In the embodiment of FIG. 5, the required imbalance force is provided by selection of the side rake angles of the cutting elements. As is well known, side rake is the lateral inclination of the cutting face of a cutting element with respect to the direction of travel of the cutting element. As shown in FIG. 5, cutting elements 40 to one side of the central axis of rotation 41 of the bit have negative side rake, that is to say their cutting faces are orientated so as to tend to urge cuttings towards the axis 41. As a result the reaction forces between the formation being cut and the cutting elements 40 have a radially outward component as indicated at 42 in FIG. 5.

Cutting elements 43 on the opposite side of the axis 41 have positive side rake, that is to say the cutting faces of the cutting elements are orientated so as to tend to urge cuttings outwardly. As a result, the reaction forces acting on the cutting elements 43 have a radially inward component as indicated by the arrow 44. The forces 42 and 44 combine to provide a net resultant force the lateral component of which constitutes the imbalance force required by the invention. The gauge portion of the drill bit is provided with two low friction bearing pads 45 which engage the formation to provide the reaction to this imbalance force.

For clarity, only some cutting elements are shown in FIG. 5. In practice a greater number of cutting elements may be employed, disposed in any required arrangements over the face of the bit. It is not necessary for all the cutting elements to have their side rake determined according to the present invention, and only some of the cutting elements may be so orientated to provide the required imbalance.

In this arrangement a drilling fluid nozzle 46 may be provided adjacent the bearing pads 45, drilling fluid flowing from the nozzle 46 being guided to flow inwardly towards the axis of rotation of the drill bit before flowing outwardly to junk slots spaced away from the bearing pads 45, so as to cool and clean the cutting elements 40. The cutting elements 43 may be cleaned and cooled by flow of drilling fluid from a nozzle 47 disposed in conventional manner adjacent the central axis of rotation of the drill bit, drilling fluid from the nozzle 47 flowing generally radially outwardly to the peripheral junk slots.

In FIGS. 6 to 9 the cutting elements and some other features, such as some nozzles and ducts for drilling fluid, are omitted for clarity.

Figure 6:
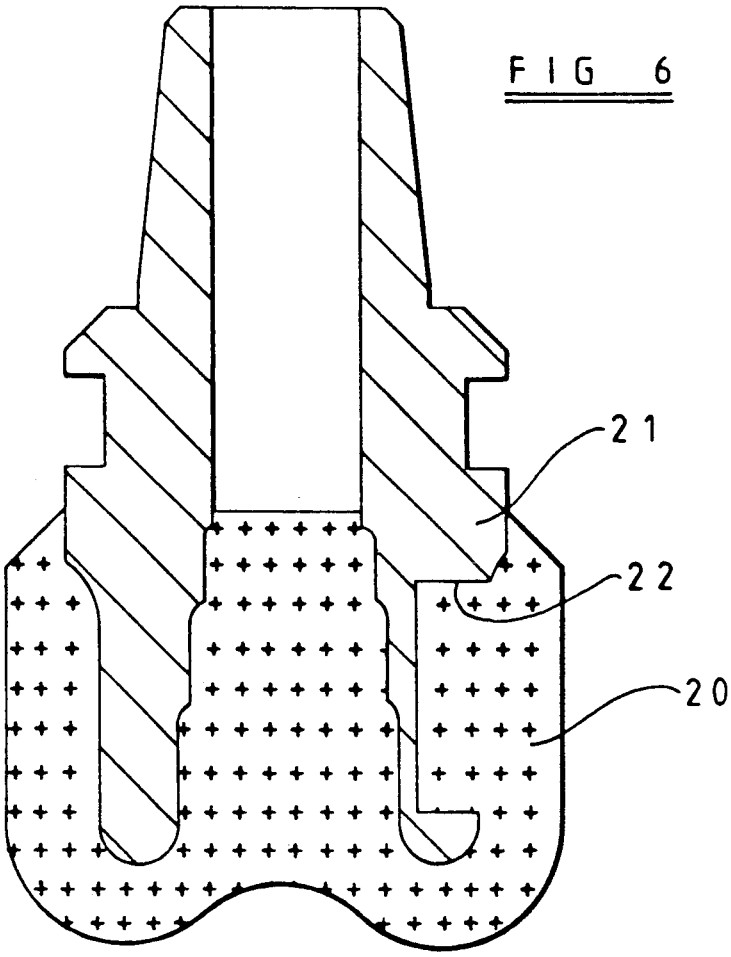
FIG. 6 is a diagrammatic longitudinal section through a drill bit in accordance with another aspect of the invention.
Figure 7:
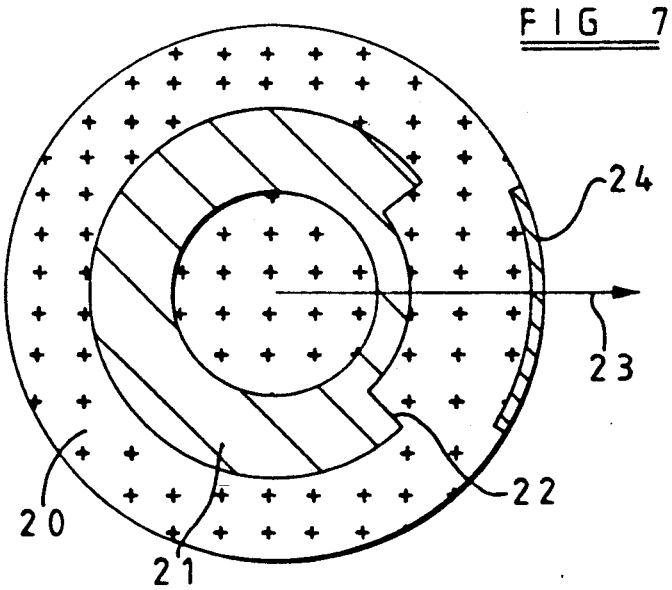
FIG. 7 is a diagrammatic horizontal section through the drill bit of FIG. 6.

Referring to FIGS. 6 and 7, the bit body comprises a solid infiltrated tungsten carbide matrix 20 moulded around a steel blank 21. This is basically a common method of forming matrix-bodied bits. In accordance with the present invention, however, a portion of the steel blank to one side of the bit is omitted, as indicated at 22 in FIGS. 6 and 7. The missing volume of steel is filled with matrix and since tungsten carbide matrix is of greater density than steel this displaces the centre of gravity of the bit body to one side of the central axis of rotation. As the bit rotates during drilling, the resultant centrifugal force imparts a lateral imbalance force to the bit as indicated at 23 in FIG. 7. Where the lateral imbalance force intersects the gauge portion of the bit, the gauge portion is formed with a low friction bearing pad as indicated diagrammatically at 24 in FIGS. 6 and 7.

Other methods may be employed for including a mass of material in the bit body assymetrically disposed with respect to the axis of rotation, in order to provide the imbalance force. For example, a symmetrical steel blank may be used in conventional fashion and the off-centre mass provided by varying the density of the tungsten carbide matrix in the bit so that a body of matrix of higher density is offset from the central axis of rotation of the bit.

Figure 8:
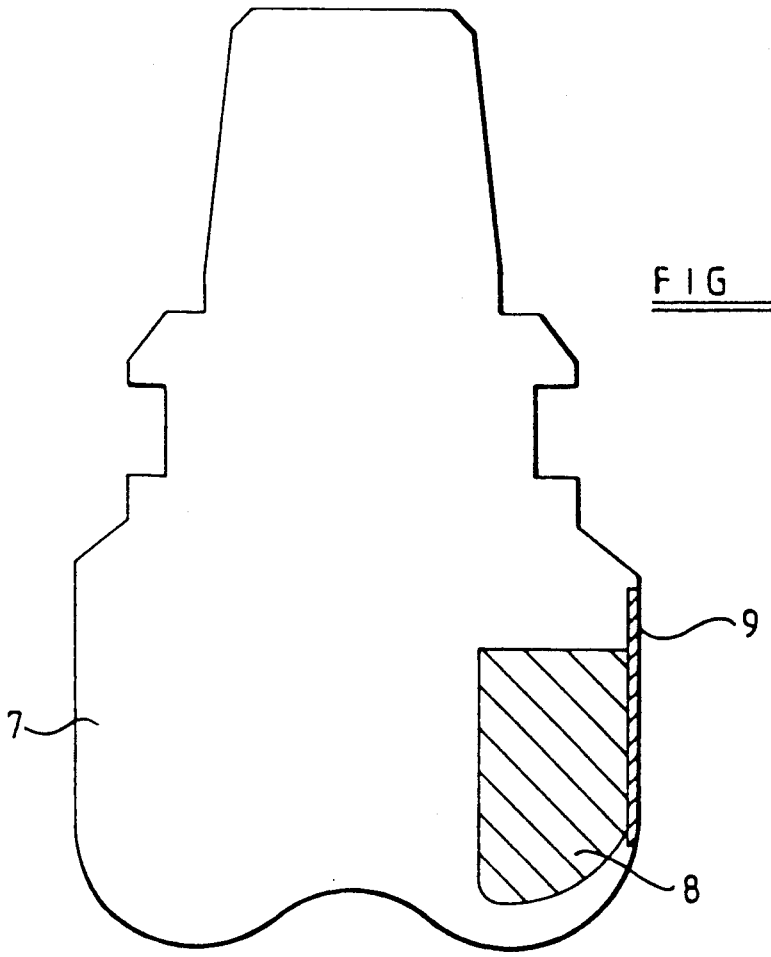
FIG. 8 is a diagrammatic longitudinal section through another embodiment of drill bit in accordance with the invention.
Figure 9:
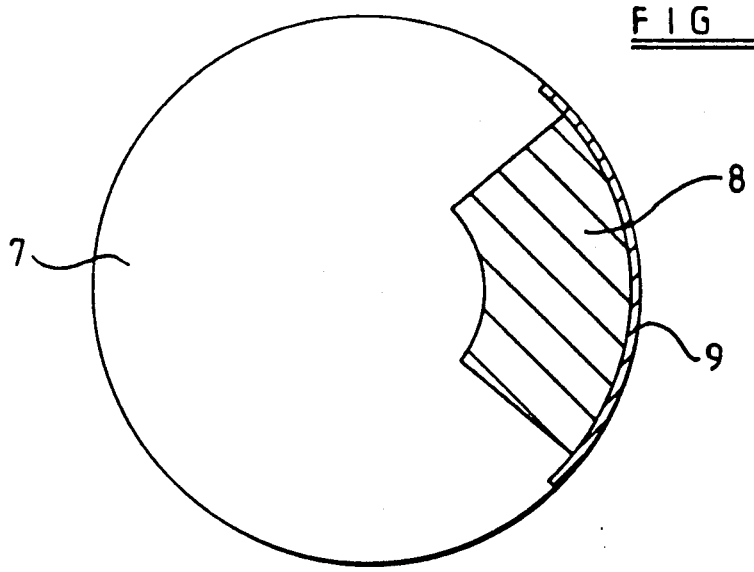
FIG. 9 is a diagrammatic horizontal section through the drill bit of FIG. 8.

Alternatively, a conventional steel or matrix-bodied bit may be rendered imbalanced by implanting a counterweight in the material of the bit body, offset from the axis of rotation. FIGS. 8 and 9 show such an arrangement where the steel or matrix bit body is indicated at 7, the counterweight at 8, and the low friction bearing pad at 9.

The latter concept may be applied to a steel bodied bit by machining a cavity in the bit body, offset from the axis of rotation, and filling the cavity with a material of higher or lower density than the steel. For example, the cavity might be filled with infiltrated tungsten carbide matrix. Alternatively the required imbalance could be achieved by leaving the cavity empty or by filling it with a lower density material.

It will be appreciated that in all of the arrangements described above the required imbalance force is provided without the necessity of omitting cutting elements from the bit body, as taught by the prior art. Accordingly, the number and disposition of the cutting elements may be selected according to the other desirable design parameters of PDC drill bits and the design of the bit need not be compromised or constrained by the necessity of omitting cutting elements from part of the drill bit.

I claim:

1. A rotary drill bit comprising a bit body having a shank for connection to a drill string and a passage for supplying drilling fluid to the face of the bit, which bit body carries a plurality of preform cutting elements each formed, at least in part, from polycrystalline diamond, said bit body comprising a solid infiltrated matrix molded around a steel blank, the steel blank including a cavity asymmetrically disposed with respect to a central axis of rotation of the bit body, and the cavity being filled with denser material, whereby the center of gravity of the bit body is offset from the axis so as to apply a resultant lateral imbalance force to the bit body at it rotates in use, the gauge of the bit body including at least one low friction bearing pad so located as to transmit said resultant lateral force to the part of the formation which the bearing pad is, for the time being, engaging.

2. A rotary drill bit according to claim 1, wherein said denser material is solid infiltrated matrix material.

3. A rotary drill bit comprising a bit body having a shank for connection to a drill string and a passage for supplying drilling fluid to the face of the bit, which bit body carries a plurality of preform cutting elements each formed, at least in part, from polycrystalline diamond, said bit body comprising a solid infiltrated matrix molded around a steel blank, a portion of the matrix asymmetrically offset from a central axis of the bit body being of different density from the rest of the matrix, whereby the center of gravity of the bit body is offset from the axis so as to apply a resultant lateral imbalance force to the bit body as it rotates in use, the gauge of the bit body including at least one low friction bearing pad so located as to transmit said resultant lateral force to the part of the formation which the bearing pad is, for the time being, engaging.

4. A rotary drill bit comprising a bit body having a shank for connection to a drill string and a passage for supplying drilling fluid to the face of the bit, which bit body carries a plurality of preform cutting elements each formed, at least in part, from polycrystalline diamond, said bit body being machined from steel and being formed with a cavity which is asymmetrically offset from a central axis of rotation of the bit body, said cavity being filled with a body of a material of different density from the steel from which the rest of the bit body is formed, where by the center of gravity of the bit body is offset from said axis so as to apply a resultant lateral imbalance force to the bit body as it rotates in use, the gauge of the bit body including at least one low friction bearing pad so located as to transmit said resultant lateral force to the part of the formation which the bearing pad is, for the time being, engaging.

* * * * *